US006962480B2

(12) United States Patent
Nguyen et al.

(10) Patent No.: US 6,962,480 B2
(45) Date of Patent: Nov. 8, 2005

(54) THERMALLY STABILIZED TURBINE SCROLL RETENTION RING FOR UNIFORM LOADING APPLICATION

(75) Inventors: Ly D. Nguyen, Phoenix, AZ (US); James L. Hadder, Scottsdale, AZ (US); Gregory O. Woodcock, Mesa, AZ (US); Stony Kujala, Tempe, AZ (US)

(73) Assignee: Honeywell International, Inc., Morristown, NJ (US)

( * ) Notice: Subject to any disclaimer, the term of this patent is extended or adjusted under 35 U.S.C. 154(b) by 26 days.

(21) Appl. No.: 10/712,434

(22) Filed: Nov. 12, 2003

(65) Prior Publication Data

US 2005/0100441 A1 May 12, 2005

(51) Int. Cl.[7] ..... F01D 25/24

(52) U.S. Cl. ..... 415/108; 415/204; 415/205; 415/213.1; 415/214.1; 416/241 B; 416/244 A

(58) Field of Search ..... 415/205, 204, 415/213.1, 108, 215.1, 214.1; 416/244 A, 416/241 B; 248/342, 343, 315; 411/544

(56) References Cited

U.S. PATENT DOCUMENTS 1,543,172 A * 6/1925 Losel ..... 415/213.1
4,425,078 A 1/1984 Robbins
4,704,075 A * 11/1987 Johnston et al. ..... 417/407
5,271,838 A * 12/1993 Rahimi et al. ..... 210/346
5,494,138 A 2/1996 Scelsi et al.
6,443,699 B1 9/2002 Mashey
2003/0122322 A1 7/2003 Tremoulet, Jr. et al.

FOREIGN PATENT DOCUMENTS

JP 54109613 A * 9/1979 ..... F04D 29/44
JP 10068330 3/1998

* cited by examiner

*Primary Examiner*—Edward K. Look
*Assistant Examiner*—Igor Kershteyn
(74) *Attorney, Agent, or Firm*—Ingrassia Fisher & Lorenz

(57) ABSTRACT

A turbine scroll retention ring may comprise a retainer ring, a plurality of ring fingers, and a plurality of ring joggles. The turbine scroll retention ring may surround and be attached to a radial nozzle. The ring joggles may allow for thermal growth variations between the radial nozzle and the turbine scroll retention ring. The radially outer end portions of the ring fingers may be in contact with a turbine scroll component (for example, an aft scroll ring), such that the turbine scroll retention ring may force contact between the turbine scroll component and the radial nozzle. The finger joggles of the ring fingers may allow for thermal growth variations between the radial nozzle and the turbine scroll component. The turbine scroll retention ring may provide constant axial loading to the aft scroll ring during all engine operating conditions.

19 Claims, 3 Drawing Sheets

THERMALLY STABILIZED TURBINE SCROLL RETENTION RING FOR UNIFORM LOADING APPLICATION

GOVERNMENT INTERESTS

The invention was made with Government support under contract number N00019-02-C-3002 with outside funding from Lockheed Martin—US Government under Joint Strike Fighter (JSF) program. The Government has certain rights in this invention.

CROSS-REFERENCE TO RELATED APPLICATIONS

The following related patent applications, assigned to the same assignee hereof and in the names of Nguyen et al, disclose related subject matter, with the subject of each being incorporated by reference herein in its entirety:

Multi-action on Multi-surface Seal with Turbine Scroll Retention Method in Gas Turbine Engine, U.S. patent application Ser. No. 10/682,217 filed Oct. 8, 2003, now pending; and Conical Helical of Spiral Combustor Scroll Device in Gas Turbine U.S. patent application Ser. No. 10/410,791 filed Mar. 11, 2003, now pending.

BACKGROUND OF THE INVENTION

The present invention generally relates to gas turbine engine systems and, more particularly, to turbine scroll assemblies.

Turbine scroll assemblies have been used extensively in gas turbine engines. The turbine scroll assembly may be positioned within a combustor housing and may surround a radial nozzle. The turbine scroll assembly may comprise a turbine scroll with a spiral contour and gradual area reduction with one end open for gas inlet and a B-width that covers the entire circumference for gas to exit. The B-width may be the opening through which gas may pass from the turbine scroll to the radial nozzle during engine operation. Thin sheet metal with a high temperature capability may be used to fabricate a turbine scroll through a forming process. It also can be fabricated from thin wall casting processes. Machined rings may be welded to the sheet metal to form specified interface characteristics and structural reinforcement. Retention assemblies may maintain the position of the turbine scroll. The retention methods may include end support of the turbine scroll, suspension of the turbine scroll by axial fasteners, suspension of the turbine scroll by a suspension pin, or retention of the turbine scroll by clamps.

During engine operation, gas may pass through the B-width and enter the radial nozzle. Conventional turbine scroll assemblies may be useful for some low cycle and low performance engines. For more advanced systems used on high performance vehicles, such as aircraft, the turbine scroll assembly must meet additional requirements. Current needs for turbine scroll systems include the ability to control small amounts of gas leakage between components at various operating conditions for performance optimization. Two main operating conditions are an open-loop condition (e.g., ground maintenance or in-flight emergency power) in which the engine runs on its own power and a closed-loop condition (e.g., taxi condition and general flight conditions) in which the engine runs on the bleed gas of the main engine. For some high performance engines, the B-width of the turbine scroll assembly may not remain constant during various engine operations such as surging or transient due to excessive pressure or differential thermal growth and inadequate scroll retention methods. This, in turn, may reduce engine performance. Additionally, in some engine systems, gas may leak at the interface between the turbine scroll and the radial nozzle, which may also reduce engine performance. Retention systems and sealing assemblies have been disclosed.

Retention systems have been described in U.S. Pat. No. 6,443,699. These systems utilize a split ring inserted in an annular groove in a counterbore to accommodate a "snap ring" configuration. The ring is positioned adjacent the aft end face of a bushing to retain the bushing against axial movement. Although, the disclosed systems may provide improved retention methods, they may not be suitable for some applications because the disclosed split ring is not symmetric. For axially loaded applications, the split ring may lead to non-uniform loading in a circumferential direction. The non-uniform loading may allow misalignment of the turbine scroll causing engine performance loss and gas leakage.

A retaining ring system has been has been disclosed in U.S. Pat. No. 4,425,078. The described ring may be axially flexible and radially stiff. Unfortunately, for some applications a retention system having radial compliance is needed. Additionally, the described ring system may not be suitable for applications having axial loading. The axially flexible ring may allow gas leakage in some applications.

A sealing assembly has been described in U.S. patent application Ser. No. 2003/0122322. The describe assembly utilizes O-rings to seal between adjacent surfaces. Although, the described sealing assembly may reduce leakage in some applications, it may not be useful in some high temperature environments. Additionally, the described sealing assembly does not provide the radial compliance and the axial load desired in some engine applications.

As can be seen, there is a need for improved turbine scroll retention assemblies. Additionally, turbine scroll assemblies are needed wherein axially loading is uniform at a variety of operating conditions. Turbine scroll retention systems having radial compliance are needed. Further, assemblies are needed wherein the B-width remains constant during engine operation.

SUMMARY OF THE INVENTION

In one aspect of the present invention, a turbine scroll retention ring for a turbine scroll assembly comprises a retainer ring; a ring joggle integral to the retainer ring; and a ring finger extending radially outward from the retainer ring.

In another aspect of the present invention, an apparatus for a turbine scroll assembly comprises a metal retainer ring; a radially inner end portion integral to the metal retainer ring; a first finger joggle extending radially outward from the radially inner end portion; a radially outer end portion extending radially outward from the first finger joggle; and a ring joggle integral to the metal retainer ring.

In still another aspect of the present invention, an assembly for a turbine engine comprises a retainer ring; a plurality of ring fingers, each ring finger in contact with and extending radially outward from the retainer ring; and a plurality of ring joggles integral to the retainer ring.

In yet another aspect of the present invention, a turbine scroll retention apparatus for a turbine engine comprises a retainer ring comprising a nickel based alloy; a plurality of fingers, each ring finger extending radially outward from the retainer ring, each ring finger comprising a radially inner end portion mechanically attached to a radial nozzle of the turbine engine, a finger joggle extending radially outward from the radially inner end portion, and a radially outer end portion extending radially outward from the finger joggle and in contact with an aft scroll ring of the turbine engine; and at least six ring joggles, each ring joggle integral to the retainer ring, each ring joggle positioned such that one ring joggle is between each pair of adjacent ring fingers.

In a further aspect of the present invention, a method of retaining a turbine scroll for a turbine engine comprises the steps of providing a turbine scroll retention ring, the turbine scroll retention ring comprising a retainer ring, a ring finger extending radially outward from the retainer ring, and a ring joggle integral to the retainer ring; positioning the turbine scroll retention ring in contact with a radial nozzle of the turbine engine; and mechanically attaching a radially inner end portion of the ring finger to the radial nozzle.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention generally provides turbine scroll assemblies and methods for producing the same. The turbine scroll assemblies produced according to the present invention may find beneficial use in many industries including aerospace, automotive, and plant operations. The turbine scroll assemblies of the present invention may be beneficial in applications including electricity generation, naval propulsion, pumping sets for gas and oil transmission, aircraft propulsion, automobile engines, and stationary power plants. This invention may be useful in any gas turbine engine application.

In one embodiment, the present invention provides a thermally stabilized turbine scroll retention ring for uniform loading application for a gas turbine engine. The turbine scroll retention ring may comprise a retainer ring, a ring finger, and a ring joggle. The ring finger may comprise a radially inner end portion, a radially outer end portion, and a finger joggle. The radially inner end portion may be mechanically attached to a radial nozzle of the gas turbine engine. The radially outer end portion may be in contact with a turbine scroll component of the turbine engine, such as an aft scroll ring, and may maintain the turbine scroll component in contact with the radial nozzle during engine operation. The finger joggle may be positioned between the radially inner end portion and the radially outer end portion. The $\phi$ angle can be varied from 30 degrees to 90 degrees, depending on the axial loading requirement. Unlike the prior art, the ring finger may provide uniform axial loading and the finger joggle may allow for the differing thermal growth of the components. The ring joggle may provide a circumferential thermal expansion to accommodate the thermal growth between the thick cast radial nozzle and retaining ring, which is also unlike the prior art.

Figure 1:
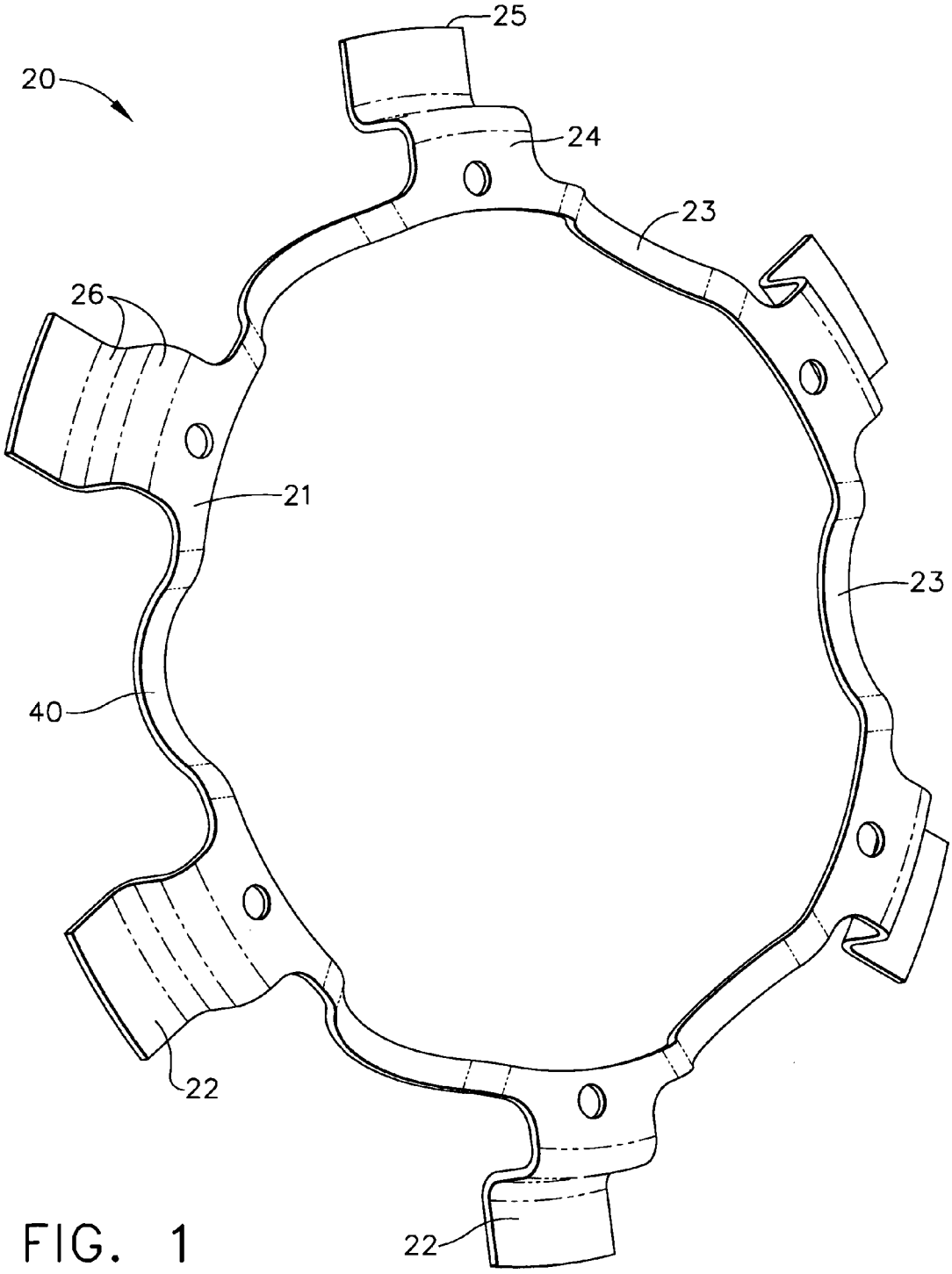
FIG. 1 is a perspective view of a turbine scroll retention ring according to one embodiment of the present invention.
Figure 2:
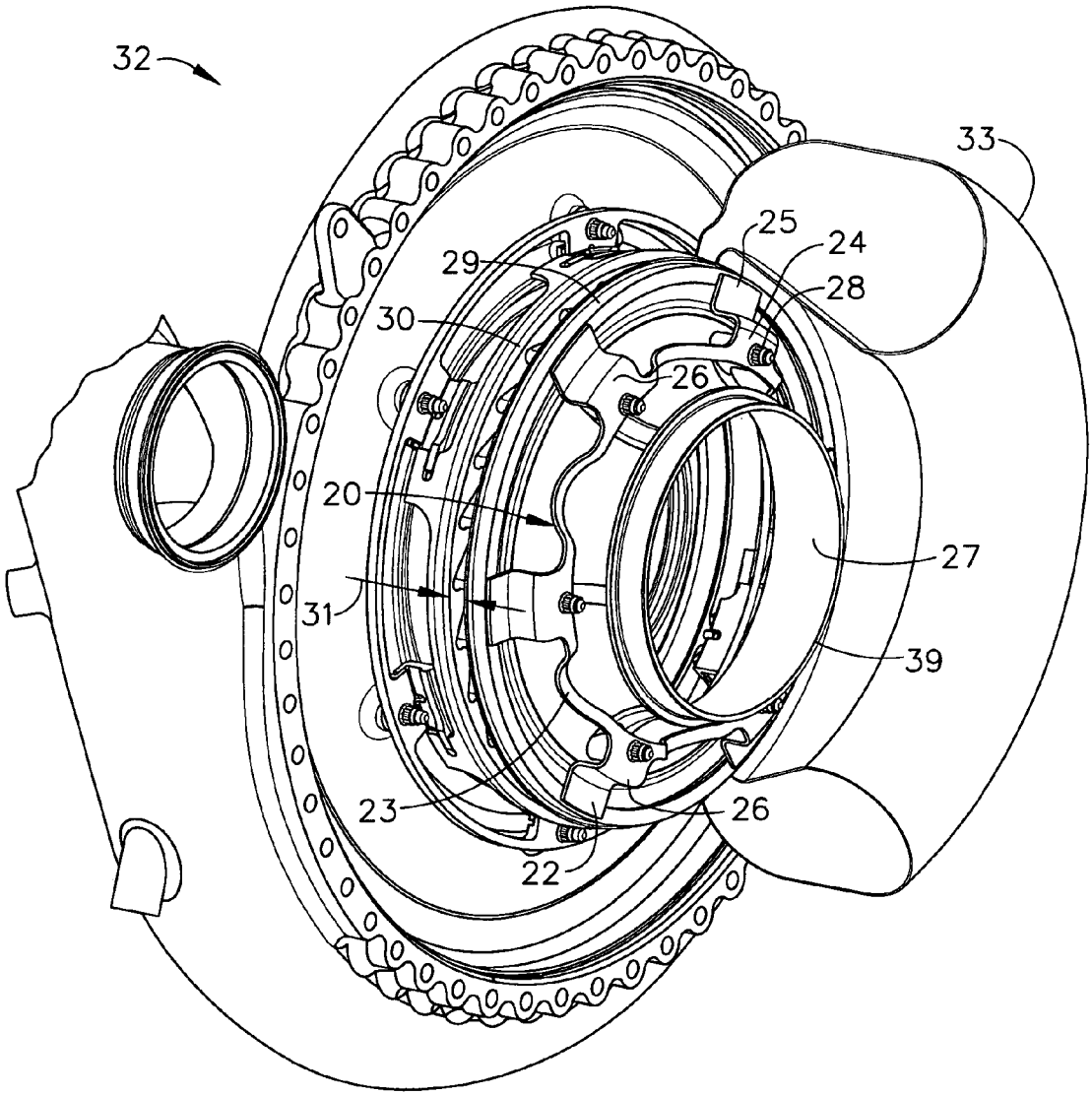
FIG. 2 is a perspective view, partially cut away, of a turbine scroll assembly according to one embodiment of the present invention.

As seen in FIG. 1, a turbine scroll retention ring 20 may comprise a retainer ring 21, a plurality of ring fingers 22, and a plurality of ring joggles 23 and finger joggles 26. The ring fingers 22 may each comprise a radially inner end portion 24, a radially outer end portion 25, and at least one finger joggle 26. The ring joggles 23 and finger joggles 26 may each comprise a notch, concavity, indentation, depression, joggle bend, hole, or other type of vacuity. As shown in FIG. 2, the turbine scroll retention ring 20 may surround a radial nozzle 27. The radially inner end portion 24 of the ring fingers 22 may be mechanically attached to the radial nozzle 27 by bolts 28. The ring joggles 23 may allow for thermal growth variations between the turbine scroll retention ring 20 and the radial nozzle 27.

Figure 3:
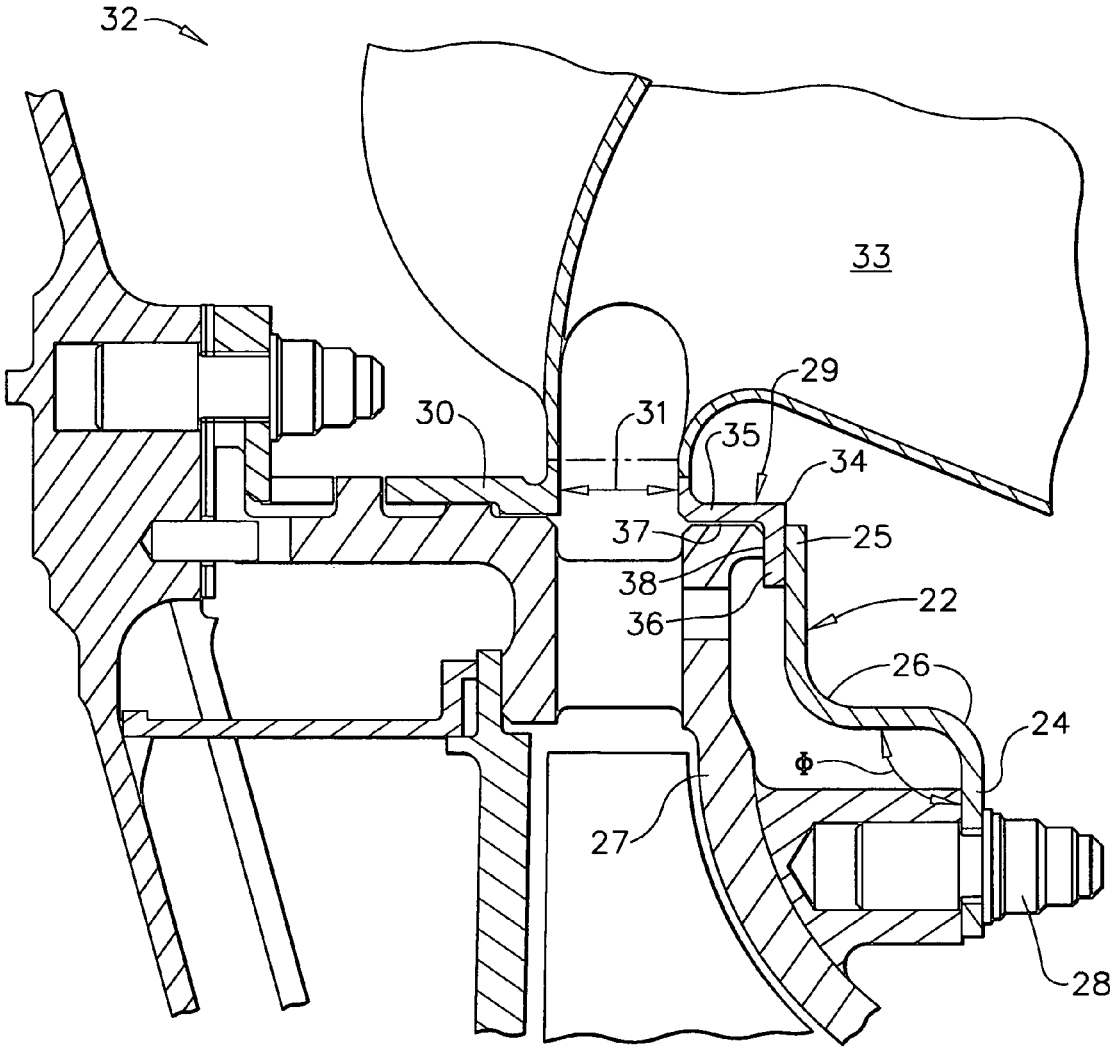
FIG. 3 is a partial cross-sectional view of a turbine scroll assembly according to one embodiment of the present invention.

Referring to FIG. 3, the turbine scroll assembly 32 may comprise a forward scroll ring 30 positioned forward of the B-width 31 and an aft scroll ring 29 positioned aft of the B-width 31. The forward scroll ring 30 and aft scroll ring 29 may be positioned between the turbine scroll 33 and the radial nozzle 27. The aft scroll ring 29 may have an aft scroll ring bend 34, such as a 90°bend, such that a first portion 35 of the aft scroll ring 29 may be radially outward from and in contact with the radial nozzle 27 and a second portion 36 of the aft scroll ring 29 may be axially aft of and in contact with the radial nozzle 27. In other words, the first portion 35 together with the second portion 36 may be "L-shaped" in cross-section, such that the aft scroll ring 29 may be capable of forming both an axial and a radial seal with the radial nozzle 27. The first portion 35 may contact the radial nozzle 27 and may form a radial seal 37. The second portion 36 may contact the radial nozzle 27 and may form an axial seal 38. The radial seal 37 and the axial seal 38 may reduce gas leakage between the aft scroll ring 29 and the radial nozzle 27.

The radially outer end portion 25 of the ring fingers 22 may contact the aft scroll ring 29 and may maintain the aft scroll ring 29 in contact with the radial nozzle 27. The finger joggles 26 may allow for thermal growth variations between the radial nozzle 27 and the aft scroll ring 29. The radially outer end portion 25 may allow axial loading during engine operation and may maintain the aft scroll ring 29 in contact with the radial nozzle 27. The axial loading may provide a mechanical means to restrain the displacement of the aft scroll ring 29 and may maintain a constant B-width 31 at all operating conditions for some applications. The $\phi$ angle can be varied for stiffness to obtain proper axial loading requirement. In one embodiment of the present invention, the radially inner end portion 24 and the radially outer end portion 25 may be in contact with components of the turbine scroll assembly, such as the radial nozzle 27 and the aft scroll ring 29, while the ring joggles 23 and finger joggles 26 may be maintained away from such components to reduce mechanical and thermal stresses to the turbine scroll retention ring 20.

The turbine scroll retention ring 20 may be produced by known manufacturing processes including casting, forging, forming, welding and machining. The ring fingers 22 may be integral to the retainer ring 21. The ring fingers 22 and the ring joggles 23 may be formed in a single stamping step. The turbine scroll retention ring 20 may comprise a metal, such as a nickel-based alloy.

The turbine scroll retention ring 20 may comprise a retainer ring 21. The dimensions of the retainer ring 21 may vary with application. The retainer ring 21 may be capable of surrounding a radial nozzle 27, as shown in FIG. 2. The diameter of a useful retainer ring 21 may be greater than the diameter of the aft end 39 of the radial nozzle 27. The thickness of the retainer ring 21 may also vary with application. Factors affecting the thickness of a useful retainer ring 21 may include the axial load of the turbine engine, the diameter of the retainer ring 21, and the material composition of the retainer ring 21. The thickness of a preferred retainer ring 21 may be between about 0.032 inches and about 0.25 inches. The thickness of a more preferred retainer ring 21 may be between about 0.063 inches to 0.090 inches. The retainer ring 21 may have a least one ring finger 22 extending radially outward there from.

The turbine scroll retention ring 20 may comprise at least one ring finger 22. The turbine scroll retention ring 20 may comprise a plurality of ring fingers 22. A preferred number of ring fingers 22 may be between about 3 and about 10. The dimensions of the ring finger 22 may vary with application and may depend on factors including thickness of the retainer ring 21 and engine conditions. The ring finger 22 may comprise a radially inner end portion 24, a radially outer end portion 25, and at least one finger joggle 26, as shown in FIG. 1. The radially inner end portion 24 may be integral to the retainer ring 21. The radially inner end portion 24 may be capable of being mechanically attached to a radial nozzle 27. Methods for mechanically attaching the radially inner end portion 24 to the radial nozzle 27 are known in the art. Any known mechanical attachment method may be useful with the present invention. Known methods may include bolting, riveting, clamping welding, and soldering. The radially inner end portion 24 may be attached to the radial nozzle 27 by bolts 28, as shown in FIGS. 2 and 3. The radially outer end portion 25 may be capable of being in contact with a turbine scroll component of the turbine scroll assembly 32, such as an aft scroll ring 29, as shown in FIG. 2. The radially outer end portion 25 may provide an axial force to the aft scroll ring 29. This axial force may maintain the aft scroll ring 29 in contact with the radial nozzle 27.

The ring finger 22 may comprise at least one finger joggle 26 positioned between the radially inner end portion 24 and the radially outer end portion 25. The finger joggle 26 may comprise a notch, concavity, indentation, depression, joggle bend, hole, or other type of vacuity. The finger joggle 26 may allow for variations in thermal expansion or contraction between the radial nozzle 27 and the turbine scroll component that may be in contact with the radially outer end portion 25. The finger joggle 26 may provide a constant axial force to push the aft scroll ring 29 in contact with the radial nozzle 27 while allowing the radially outer end portion 25 of the ring finger 22 to slide to alleviate thermal stress. As shown in FIG. 3, the finger joggle 26 may comprise a $\phi$ angle. The $\phi$ angle may be between about 30 degrees and about 90 degrees. The $\phi$ angle can be a means to provide proper axial loading.

The turbine scroll retention ring 20 may comprise at least one ring joggle 23. The ring joggle 23 may comprise a notch, concavity, indentation, depression, joggle bend, hole, or other type of vacuity. The ring joggle 23 may allow for variations in thermal expansion or contraction between the radial nozzle 27 and the radially inner end portion 24 of the ring finger 22. The ring joggle 23 may maintain the angular orientation of the ring fingers 22. The ring joggle 23, as shown in FIG. 1, may comprise a joggle bend 40 such that a single stamping step process may be utilized to form the ring joggle 23. As used herein, a joggle bend 40 and an aft scroll ring bend 34 both may be bends; the terms are used to make a distinction between these two bends.

As can be appreciated by those skilled in the art, the present invention provides improved turbine scroll retention assemblies and methods for their production. A turbine scroll assembly capable of decreasing gas leakage is provided. Also provided are turbine scroll retention assemblies capable of maintaining a constant B-width. Further, a turbine scroll retention ring capable of alleviating thermal and mechanical stresses is provided.

It should be understood, of course, that the foregoing relates to preferred embodiments of the invention and that modifications may be made without departing from the spirit and scope of the invention as set forth in the following claims.

We claim:

1. A turbine scroll retention ring for a turbine scroll assembly comprising:

a retainer ring;

a plurality of ring fingers, each said ring finger extending radially outward from said retainer ring, each said ring finger comprising a radially inner end portion mechanically attached to a radial nozzle of said turbine engine, a finger joggle extending radially outward from said radially inner end portion, and a radially outer end portion extending radially outward from said finger joggle and in contact with an aft scroll ring of said turbine engine; and a plurality of ring joggles, each said ring joggle integral to said retainer ring, each said ring joggle positioned such that one said ring joggle is between each pair of adjacent said ring fingers.

2. The turbine scroll retention ring of claim 1, wherein said finger joggle comprises a joggle bend.

3. The turbine scroll retention ring of claim 1, wherein said finger joggle comprises a $\phi$ angle between about 30 degrees and about 90 degrees.

4. The turbine scroll retention ring of claim 1, wherein said ring joggle comprises a joggle bend.

5. The turbine scroll retention ring of claim 1, wherein said retainer ring comprises a nickel-based alloy.

6. The turbine scroll retention ring of claim 1, wherein said retainer ring has a thickness between about 0.032 inches and about 0.25 inches.

7. An apparatus for a turbine scroll assembly comprising:

a metal retainer ring comprising a plurality of ring fingers, each ring finger extending radially outward from said retainer ring;

a radially inner end portion integral to said metal retainer ring;

a first finger joggle extending radially outward from said radially inner end portion;

a radially outer end portion extending radially outward from said first finger joggle; and a plurality of ring joggles integral to said metal retainer ring, each ring joggle positioned such that one said ring joggle is between each pair of adjacent said ring fingers.

8. The apparatus of claim 7, wherein said ring joggle comprises a joggle bend.

9. The apparatus of claim 7, wherein said first finger joggle comprises a nickel based alloy.

10. The apparatus of claim 7, further comprising a second finger joggle positioned between and integral to said first finger joggle and said radially outer end portion.

11. The apparatus of claim 7, wherein said radially outer end portion comprises a nickel based alloy.

12. The apparatus of claim 7, wherein said radially outer end portion is capable of being in contact with an aft scroll ring of said turbine scroll assembly.

13. The apparatus of claim 12, wherein said radially inner end is capable of being in contact with a radial nozzle of said turbine scroll assembly.

14. A turbine scroll retention apparatus for a turbine engine comprising:

a retainer ring comprising a nickel based alloy;

a plurality of ring fingers, each said ring finger extending radially outward from said retainer ring, each said ring finger comprising a radially inner end portion mechanically attached to a radial nozzle of said turbine engine, a finger joggle extending radially outward from said radially inner end portion, and a radially outer end portion extending radially outward from said finger joggle and in contact with an aft scroll ring of said turbine engine; and a plurality of ring joggles, each said ring joggle integral to said retainer ring, each said ring joggle positioned such that one said ring joggle is between each pair of adjacent said ring fingers.

15. A method of retaining a turbine scroll for a turbine engine comprising the steps of:

providing a turbine scroll retention ring, said turbine scroll retention ring comprising a retainer ring, a ring finger extending radially outward from said retainer ring, and a ring joggle integral to said retainer ring;

positioning said turbine scroll retention ring in contact with a radial nozzle of said turbine engine; and mechanically attaching a radially inner end portion of said ring finger to said radial nozzle.

16. The method of claim 15, further comprising a step of providing at least one finger joggle integral to said ring finger.

17. The method of claim 15, further comprising the step of positioning a radially outer end portion of said ring finger in contact with an aft scroll ring of said turbine engine.

18. The method of claim 15, wherein said step of mechanically attaching comprises bolting.

19. The method of claim 15, wherein said turbine scroll retention ring comprises a nickel-based alloy.

* * * * *